US010344423B2

(12) United States Patent
Leibman et al.

(10) Patent No.: US 10,344,423 B2
(45) Date of Patent: Jul. 9, 2019

(54) PRETREATMENT ASSEMBLY FOR A WASHING MACHINE APPLIANCE

(71) Applicant: Haier US Appliance Solutions, Inc., Wilmington, DE (US)

(72) Inventors: Alexander B. Leibman, Prospect, KY (US); Eric Ormsby Sakal, Louisville, KY (US); James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/687,596

(22) Filed: Aug. 28, 2017

(65) Prior Publication Data

US 2019/0062983 A1 Feb. 28, 2019

(51) Int. Cl.

| | |
|---|---|
| ***D06F 23/04*** | (2006.01) |
| ***D06F 33/02*** | (2006.01) |
| ***D06F 37/12*** | (2006.01) |
| ***D06F 39/00*** | (2006.01) |
| ***D06F 39/02*** | (2006.01) |
| ***D06F 39/12*** | (2006.01) |
| ***D06F 43/00*** | (2006.01) |

(52) U.S. Cl.

CPC ..... *D06F 43/002* (2013.01); *D06F 23/04* (2013.01); *D06F 33/02* (2013.01); *D06F 37/12* (2013.01); *D06F 39/005* (2013.01); *D06F 39/022* (2013.01); *D06F 39/024* (2013.01); *D06F 39/12* (2013.01)

(58) Field of Classification Search

CPC ..... D06F 23/04; D06F 33/02; D06F 37/12; D06F 39/005; D06F 39/022; D06F 39/02; D06F 39/12; D06F 43/002

USPC ..... 68/17 R, 207

See application file for complete search history.

(56) References Cited

U.S. PATENT DOCUMENTS

| | | | | |
|---|---|---|---|---|
| 5,341,660 | A | 8/1994 | Berveglieri | |
| 2005/0101502 | A1 | 5/2005 | Barnes et al. | |
| 2012/0263516 | A1* | 10/2012 | Turchi | D06F 39/024 401/263 |
| 2013/0327101 | A1* | 12/2013 | Leibman | D06F 71/10 68/17 R |

FOREIGN PATENT DOCUMENTS

| | | |
|---|---|---|
| CN | 204919104 U | 12/2015 |

* cited by examiner

*Primary Examiner* — Levon J Shahinian
(74) *Attorney, Agent, or Firm* — Dority & Manning, P.A.

(57) ABSTRACT

A washing machine appliance includes a pretreatment assembly positioned proximate a top panel of the washing machine appliance for spot treating articles of clothing prior to a wash cycle. The pretreatment assembly includes a detergent reservoir defining an aperture and being configured for receiving a fluid additive. A ball socket is positioned at least partially within the aperture and a roller ball applicator is rotatably mounted within the ball socket. The roller ball applicator is at least partially in contact with the fluid additive within the detergent reservoir such that a user may rub an article of clothing on the roller ball applicator to transfer fluid additive from the detergent reservoir to the article of clothing.

20 Claims, 4 Drawing Sheets

PRETREATMENT ASSEMBLY FOR A WASHING MACHINE APPLIANCE

FIELD OF THE INVENTION

The present subject matter relates generally to washing machine appliances and more particularly to pretreatment assemblies for washing machine appliances.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

During operation of certain washing machine appliances, a volume of wash fluid is directed into the tub in order to wash and/or rinse articles within the wash chamber. However, in certain situations, a user may wish to pretreat an article of clothing, e.g., by spot treating a specific region on the article with wash additive and/or rubbing or agitating the clothing against a cleaning implement or tool.

However, conventional washing machine appliances do not include integral features for providing a small, localized quantity of detergent to an article of clothing for pretreating purposes. Although a user could pour detergent directly from the bottle or use a stand-alone applicator to pretreat an article of clothing, such options are typically messier and require additional tools which are not often conveniently stored or accessible.

Accordingly, a washing machine appliance that provides a quick and easy feature for performing a pretreating operation is desirable. In particular, a pretreating assembly that is integral to a washing machine appliance and enables effective localized pretreating of an article of clothing would be particularly beneficial.

BRIEF DESCRIPTION OF THE INVENTION

The present subject matter provides a washing machine appliance including a pretreatment assembly positioned proximate a top panel of the washing machine appliance for spot treating articles of clothing prior to a wash cycle. The pretreatment assembly includes a detergent reservoir defining an aperture and being configured for receiving a fluid additive. A ball socket is positioned at least partially within the aperture and a roller ball applicator is rotatably mounted within the ball socket. The roller ball applicator is at least partially in contact with the fluid additive within the detergent reservoir such that a user may rub an article of clothing on the roller ball applicator to transfer fluid additive from the detergent reservoir to the article of clothing. Additional aspects and advantages of the invention will be set forth in part in the following description, or may be apparent from the description, or may be learned through practice of the invention.

In one exemplary embodiment, a washing machine appliance defining a vertical, a lateral, and a transverse direction is provided. The washing machine appliance includes a cabinet including a top panel and a pretreatment assembly positioned proximate the top panel. The pretreatment assembly includes a detergent reservoir defining an aperture and being configured for receiving a fluid additive. A ball socket is positioned at least partially within the aperture and a roller ball applicator is rotatably mounted within the ball socket and is at least partially in contact with the fluid additive within the detergent reservoir.

In another exemplary embodiment, a pretreatment assembly is positioned proximate a top panel of a washing machine appliance. The pretreatment assembly includes a detergent reservoir defining an aperture and being configured for receiving a fluid additive. A ball socket is positioned at least partially within the aperture and a roller ball applicator is rotatably mounted within the ball socket and is at least partially in contact with the fluid additive within the detergent reservoir.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
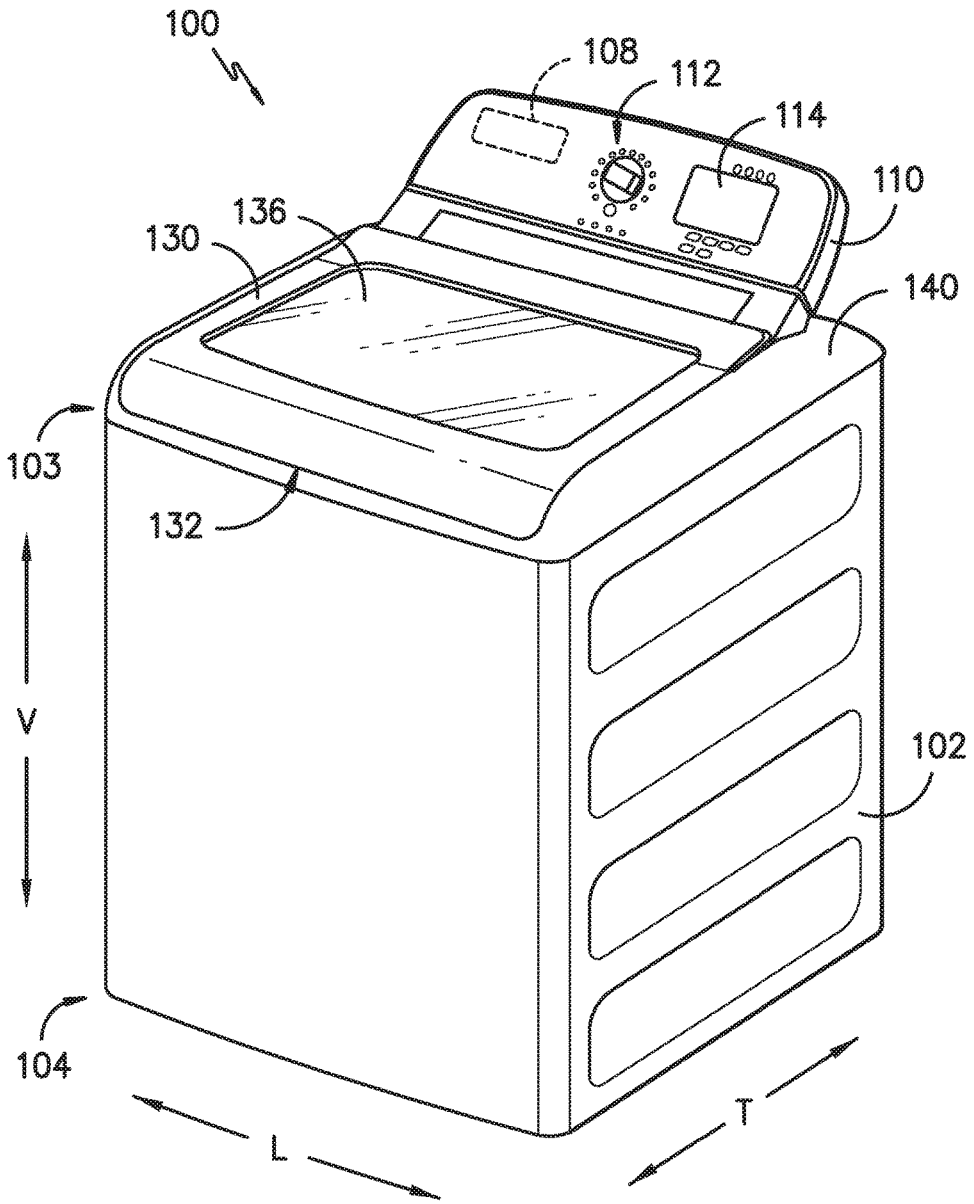
FIG. 1 provides a perspective view of a washing machine appliance according to an exemplary embodiment of the present subject matter with a door of the exemplary washing machine appliance shown in a closed position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
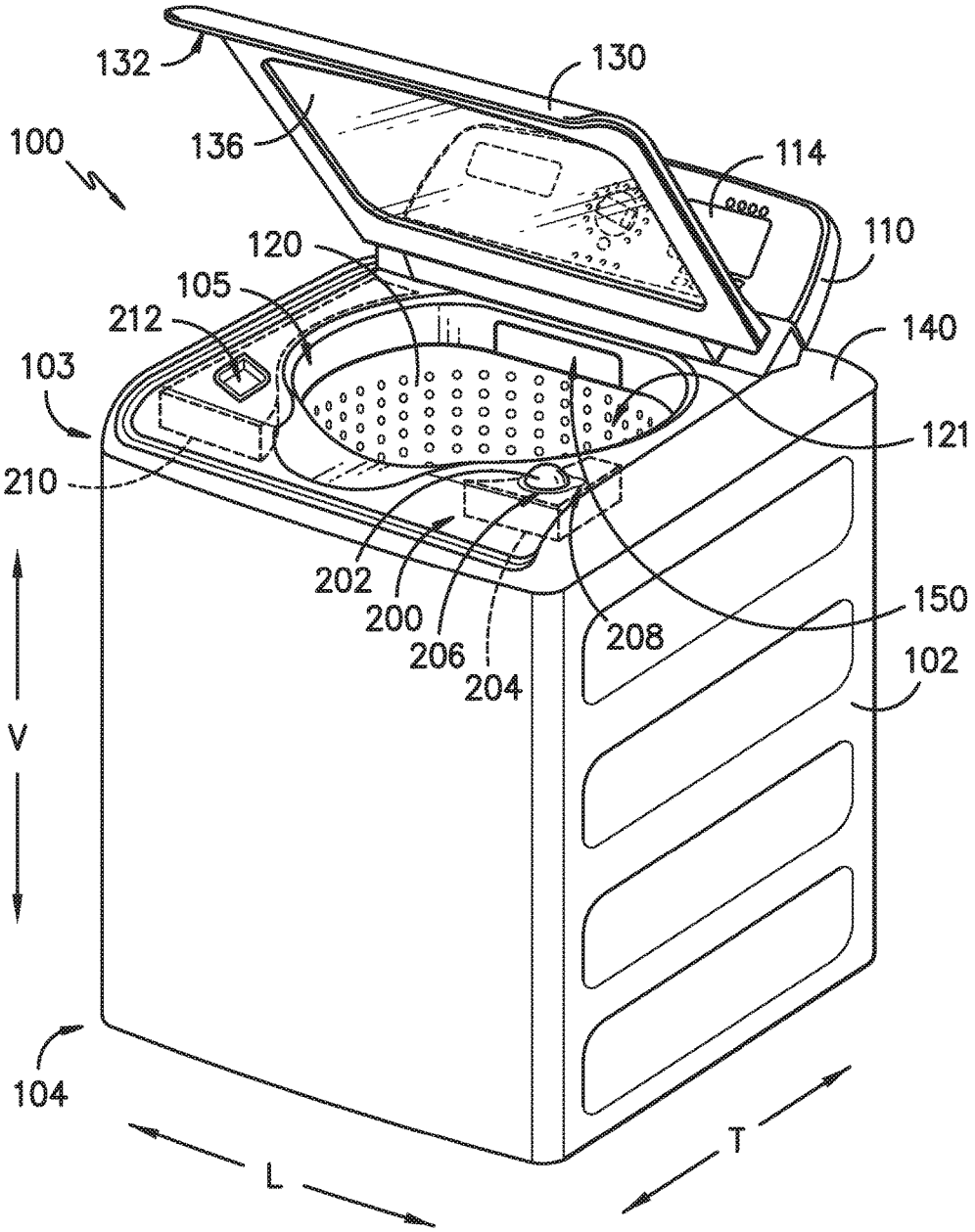
FIG. 2 provides a perspective view of the exemplary washing machine appliance of FIG. 1 with the door of the exemplary washing machine appliance shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines. Moreover, aspects of the present subject matter may be used in any other consumer or commercial appliance where it is desirable to facilitate quick and easy application of a wash additive for a pretreat operation.

Washing machine appliance 100 has a cabinet 102 that extends between a top portion 103 and a bottom portion 104 along the vertical direction V. A wash basket 120 (FIG. 2) is rotatably mounted within cabinet 102. A motor (not shown) is in mechanical communication with wash basket 120 to selectively rotate wash basket 120 (e.g., during an agitation or a rinse cycle of washing machine appliance 100). Wash basket 120 is received within a wash tub or wash chamber 121 (FIG. 2) and is configured for receipt of articles for washing. The wash tub 121 holds wash and rinse fluids for agitation in wash basket 120 within wash tub 121. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140. Top panel 140 defines an opening 105 (FIG. 2) that permits user access to wash basket 120 of wash tub 121. Door 130, rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 (FIG. 1) that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are loaded into wash basket 120 through opening 105, and washing operation is initiated through operator manipulation of input selectors 112. Wash basket 120 is filled with water and detergent and/or other fluid additives via a nozzle assembly 150, which will be described in detail below. One or more valves can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through opening 105.

Referring now generally to FIGS. 2 through 6, a pretreatment assembly 200 will be described in more detail according to various exemplary embodiments of the present subject matter. Although the discussion below refers to pretreatment assembly 200, one skilled in the art will appreciate that the features and configurations described may be used for other pretreating tools in other washing machine appliances as well. For example, pretreatment assembly 200 may be positioned in another location within cabinet 102 and may be positioned in a dedicated pretreat dispenser containing any suitable wash fluid or fluids such as water, detergent, other additives, or mixtures thereof. Other variations and modifications of the exemplary embodiment described below are possible, and such variations are contemplated as within the scope of the present subject matter.

Referring now to FIG. 2, washing machine appliance 100 includes a pretreatment assembly 200 positioned in a front corner of top panel 140. As will be described in more detail below with respect to FIGS. 4 through 6, pretreatment assembly 200 includes a roller ball applicator 202 that is positioned and configured for coming into contact with a fluid additive within a detergent reservoir. As illustrated in FIG. 2, the detergent reservoir is a dedicated pretreatment reservoir 204 (see also, e.g., FIG. 3) that contains any suitable pretreating fluid or wash additive, such as detergent, vinegar, bleach, water, etc.

As illustrated, pretreatment reservoir 204 is positioned just below top panel 140 such that pretreatment assembly 200 is positioned over pretreatment reservoir 204 which contains the dedicated pretreatment additive. In addition, pretreatment reservoir 204 (and top panel 140) define an aperture 206 through which roller ball applicator 202 may extend above top panel 140 for easy access by a user. To supply fluid into pretreatment reservoir 204, top panel 140 (and pretreatment reservoir 204) further define a loading port 208 adjacent aperture 206 in pretreatment reservoir 204 for pouring fluid additive into pretreatment reservoir 204. However, it should be appreciated that fluid additive may be added into pretreatment reservoir 204 in any other suitable manner.

Although illustrated in FIG. 2 as being used with pretreatment reservoir 204, it should be appreciated that pretreatment assembly 200 may be configured for use with any detergent reservoir. For example, referring now also to FIG. 3, washing machine appliance 100 may include a primary detergent reservoir 210 for receiving a primary wash detergent or additive. As illustrated, primary detergent reservoir 210 is a large bulk additive dispenser positioned below top panel 140 on a left side of washing machine appliance 100. For example, primary detergent reservoir 210 may be a plastic dispenser snapped into or otherwise joined within top panel 140. According to another embodiment, primary detergent reservoir 210 is defined in part by top panel 140. Primary detergent reservoir 210 may be filled with liquid detergent, e.g., using a primary additive port 212. According to the exemplary embodiment, three pretreatment assemblies 200 are positioned over and configured for use with primary detergent reservoir 210.

Figure 3:
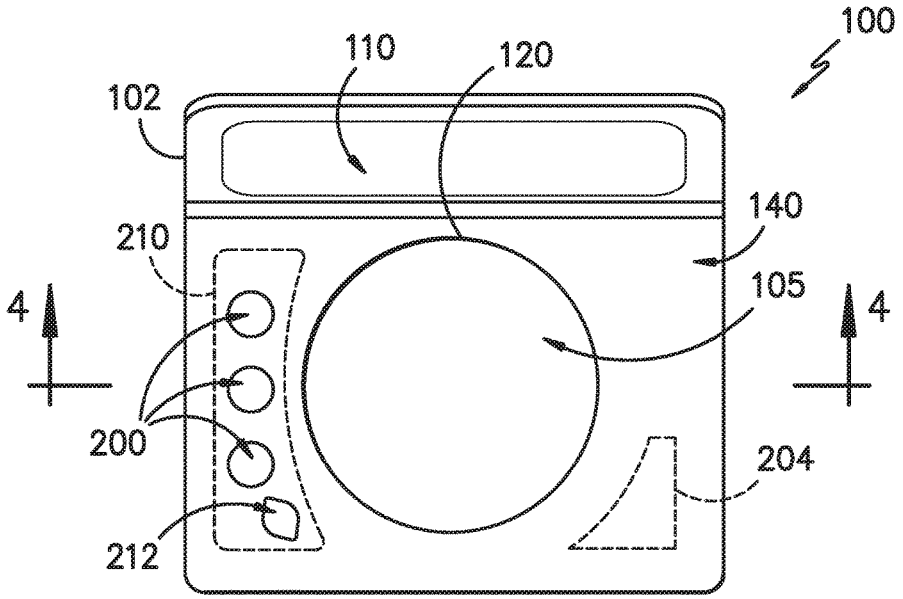
FIG. 3 provides a schematic top view of a washing machine appliance according to another exemplary embodiment of the present subject matter.

As illustrated in FIGS. 2 and 3, one or more pretreatment assemblies 200 may be operably coupled to either a dedicated pretreatment reservoir 204 separate from primary detergent reservoir 210 (e.g., FIG. 2) or directly to primary detergent reservoir 210 (e.g., as illustrated in FIG. 3). Moreover, although one pretreatment assembly 200 is illustrated in FIG. 2 and three pretreatment assemblies 200 are illustrated in FIG. 3, it should be appreciated that any suitable number, size and position of pretreatment assemblies 200 may be used according to alternative embodiments.

Figure 4:
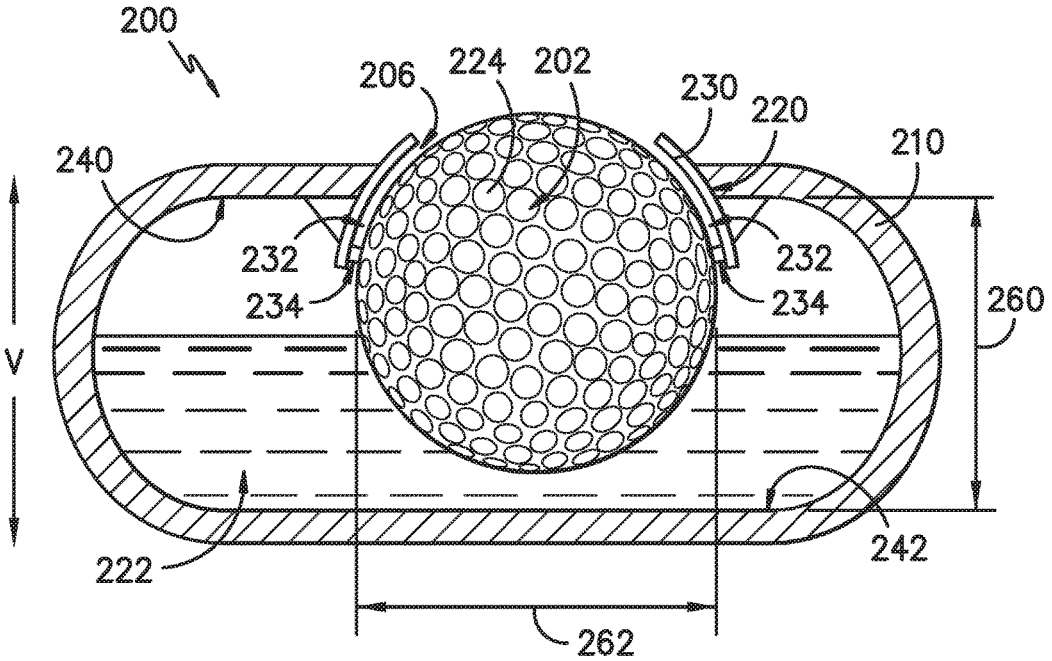
FIG. 4 provides a cross sectional view of a pretreatment assembly of the exemplary washing machine appliance of FIG. 1, taken along Line 4-4 of FIG. 3.
Figure 5:
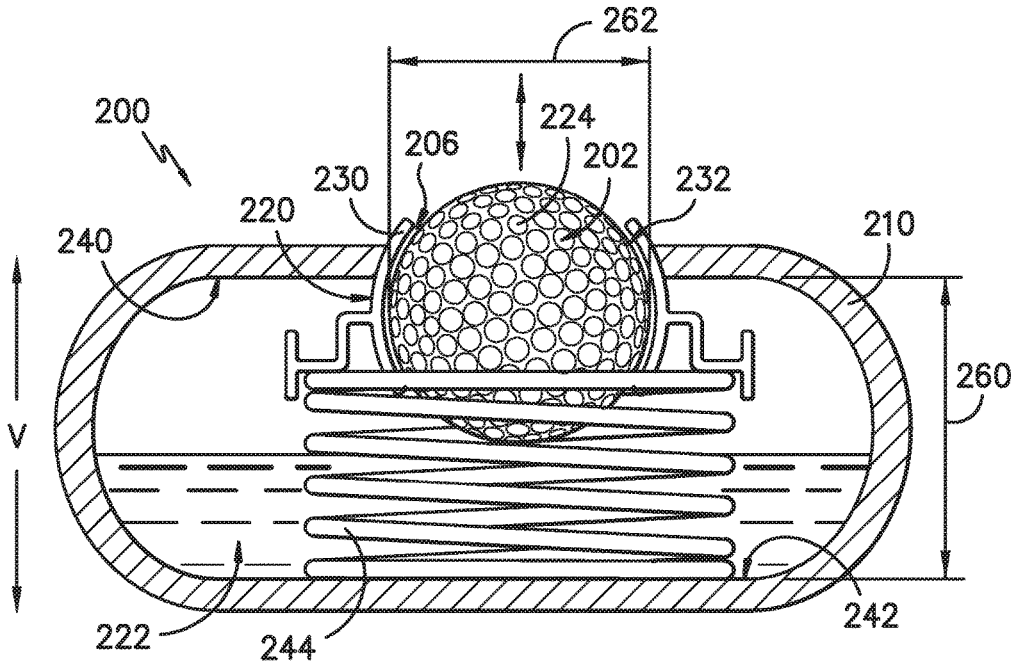
FIG. 5 provides a cross sectional view of a pretreatment assembly of the exemplary washing machine appliance of FIG. 1 according to another exemplary embodiment of the present subject matter.
Figure 6:
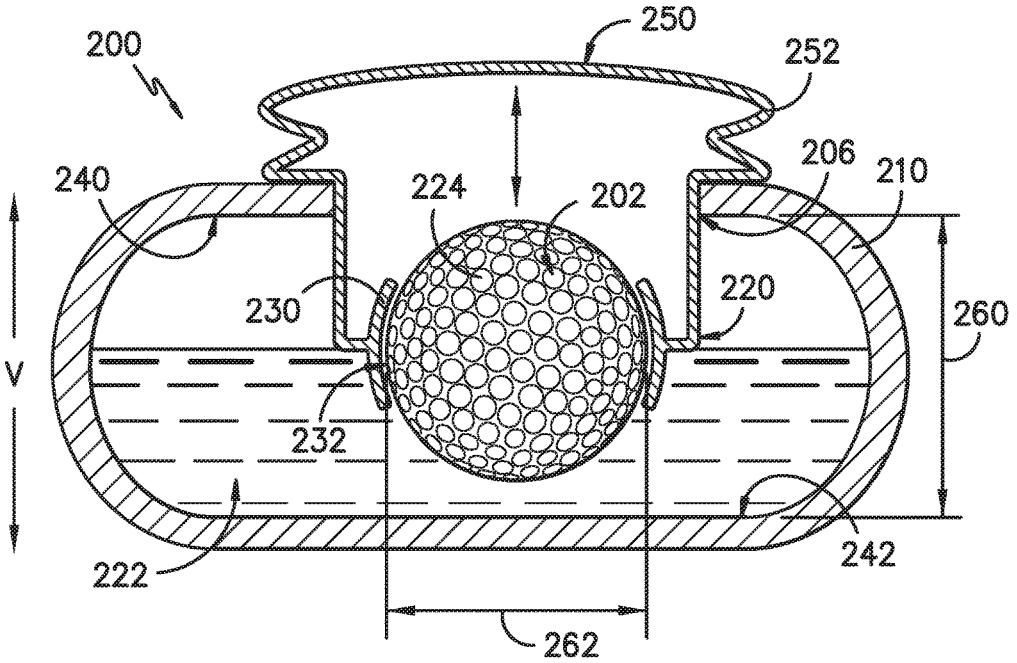
FIG. 6 provides a cross sectional view of a pretreatment assembly of the exemplary washing machine appliance of FIG. 1 according to another exemplary embodiment of the present subject matter.

Referring now to FIGS. 4 through 6, pretreatment assemblies 200 will be described according to various embodiments of the present subject matter. Due to the similarity in construction of the pretreatment assemblies 200 described, like reference numerals may be used to refer to the same or similar features in each embodiment. Each of FIGS. 4 through 6 illustrates a cross sectional view of an exemplary pretreatment assembly 200 as taken along Line 4-4 of FIG. 3. Notably, FIGS. 4 through 6 illustrate only portions of pretreatment assemblies 200 for the purpose of explaining aspects of the present subject matter, while other components are removed for clarity (e.g., top panel 140 is not shown in these figures). In addition, pretreatment assemblies 200 are only examples and other types and configurations of pretreatment assemblies may be used according to alternative embodiments. The particular exemplary embodiment described is not intended to limit the subject matter of the present disclosure in any manner.

Referring now to FIG. 4, pretreatment assembly 200 includes a ball socket 220 positioned at least partially within aperture 206 of detergent reservoir 210. In addition, roller ball applicator 202 is rotatably mounted within ball socket 220 and is at least partially in contact with a fluid additive 222 within detergent reservoir 210. As used herein, roller ball applicator 202 may be used to refer to any tool or implement that is used for transferring fluid additive 222 from detergent reservoir 210 onto an article of clothing. In addition, roller ball applicator 202 is generally used for agitating, rubbing, or otherwise working fluid additive 222 into the article of clothing in order to pretreat the article.

According to the illustrated embodiment, roller ball applicator 202 is a spherical ball defining a plurality of dimples 224 (e.g., similar to a golf ball). Dimples 224 may facilitate an improved coating of fluid additive 222 which is drawn out of detergent reservoir 210 as roller ball applicator 202 is rotated. In addition, dimples 224 generally create more friction with ball socket 220 (to provide some rolling resistance) and with the article of clothing (to impart improve cleaning or pretreating action). Although roller ball applicator 202 is illustrated herein as including dimples 224, it should be appreciated that any other suitable texture or features may be defined by roller ball applicator 202 for improving the pretreatment action. For example, roller ball applicator 202 may include ridges, bristles, or any other suitably textured surface according to alternative embodiments.

Ball socket 220 is generally any structure sufficient for retaining roller ball applicator 202 while allowing roller ball applicator 202 to rotate within ball socket 220 (e.g., similar to a ball-point pin). In this regard, as illustrated for example in FIG. 4, ball socket 220 defines a spherical flange 230 extending around roller ball applicator 202 to retain roller ball applicator 202. More specifically, as illustrated in FIG. 4, spherical flange 230 is positioned around an upper hemisphere of roller ball applicator 202, e.g., to prevent its removal through aperture 206. By contrast, as illustrated in FIGS. 5 and 6, spherical flange 230 extends around a circumference of roller ball applicator 202 (e.g., through its center) to prevent movement up or down relative to spherical flange 230.

Notably, the tolerances between spherical flange 230 and roller ball applicator 202 may be selected to achieve the desired amount of friction and rotational ability of roller ball applicator 202 while ensuring that roller ball applicator 202 is retained within spherical flange 230 or pretreatment assembly 200.

In this regard, for example, a gap 232 is defined between ball socket 220 (i.e., spherical flange 230) and roller ball applicator 202. In general, the size of gap 232 is selected to generate some desired amount of rolling resistance between roller ball applicator 202 and ball socket 220. Moreover, as illustrated for example in FIG. 4, pretreatment assembly 200 may include one or more resistance features 234 positioned in contact with roller ball applicator 202. For example, resistance features 234 may be positioned between spherical flange 230 and roller ball applicator 202 and may be spaced apart circumferentially to achieve the desired rotational resistance. Resistance features 234 may be small resilient members (e.g., rubber pads) or may be extensions of spherical flange 230. Other features and configurations are possible and within the scope of the present subject matter.

As illustrated in FIG. 4, ball socket 220 is defined by or directly coupled to detergent reservoir 210. In this regard, for example, ball socket 220 is immovable relative to detergent reservoir 210. However, according to alternative embodiments, ball socket 220 may be movable relative to detergent reservoir 210. For example, the embodiments described below with respect to FIGS. 5 and 6 both include ball sockets 220 that may move along with roller ball applicator 202.

As illustrated in FIG. 5, ball socket 220 is spring-loaded against a top wall 240 of detergent reservoir 210. More specifically, detergent reservoir 210 generally defines top wall 240 and a bottom wall 242 separated along the vertical direction V. As illustrated, a mechanical spring 244 extends between bottom wall 242 of detergent reservoir 210 and ball socket 220 for urging ball socket 220 toward top wall 240 of detergent reservoir 210. Although a single mechanical spring 244 is illustrated in FIG. 5, it should be appreciated that any suitable number, size, spacing, and configuration of springs could be used to urge roller ball applicator 202 against top wall 240 according to alternative embodiments.

In operation, the roller ball applicator 202 of FIG. 5 may be positioned above fluid additive 222, particularly when detergent reservoir 210 is almost empty. A user may perform a pretreatment operation by pressing the article of clothing onto the roller ball applicator 202 and rubbing it around. In this manner, mechanical springs 244 are compressed such that roller ball applicator 202 dips into fluid additive 222 and transfers fluid additive 222 onto the clothing.

Referring now to FIG. 6, ball socket 220 is attached to a removable applicator 250. Removable applicator 250 is inserted through aperture 206 in detergent reservoir 210 for inserting ball socket 220 and roller ball applicator 202 into fluid additive 222 within detergent reservoir 210. For example, as illustrated, removable applicator 250 has a hand grip 252 that a user may grasp to remove the removable applicator 250 from detergent reservoir 210 and roll over an article of clothing. After the article of clothing has been pretreated, or if more fluid additive is needed on roller ball applicator 202, removable applicator 250 may be returned to its seated position within aperture 206.

Whether pretreatment assembly 200 is configured as shown in FIG. 4, 5, or 6, it may be desirable to size roller ball applicator 202 to achieve sufficient immersion within fluid additive 222 and provide sufficiently large spot treatment to the articles of clothing. For example, as illustrated in FIG. 4, detergent reservoir 210 defines a reservoir height 260 measured between top wall 240 and bottom wall 242 along the vertical direction V. For example, according to the illustrated exemplary embodiment, reservoir height 260 is approximately four inches (approximately 100 millimeters). In addition, roller ball applicator 202 defines a ball diameter 262. According to the embodiment of FIG. 4, ball diameter 262 is larger than reservoir height 260, e.g., because ball socket 220 only retains roller ball applicator 202 within pretreatment assembly 200 and does not provide vertical support.

By contrast, according to the embodiments illustrated in FIGS. 5 and 6, ball diameter 262 is less than or equal to reservoir height 260. For example, according to these illustrated embodiments, reservoir height 260 is approximately four inches (approximately 100 millimeters) and ball diameter 262 is approximately three inches (approximately 75 millimeters). It should be appreciated that these values are only exemplary and may vary according to alternative embodiments.

Pretreatment assemblies 200 as described above provide a quick and easy tool for pretreating an article of clothing with a pretreatment additive prior to a wash cycle. In addition, pretreatment assemblies 200 may be integral with washing machine appliance 100, such that mess associated with separate applicators is eliminated and a neat, consumer-desirable solution is obtained. Pretreatment assemblies 200 are also easily accessible at top panel 140, e.g., when door 130 is in the open position, as it would be prior to a wash cycle. It should be appreciated that the pretreatment assemblies 200 described herein are only exemplary and are not intended to limit the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical, a lateral, and a transverse direction, the washing machine appliance comprising:

a cabinet including a top panel; and a pretreatment assembly positioned proximate the top panel, the pretreatment assembly comprising:

a detergent reservoir defining an aperture and being configured for receiving a fluid additive;

a ball socket positioned at least partially within the aperture, the ball socket comprising one or more small resilient members positioned inside the ball socket; and a roller ball applicator rotatably mounted within the ball socket and being at least partially in contact with the fluid additive within the detergent reservoir, wherein the one or more small resilient members extend toward and contact the roller ball applicator.

2. The washing machine appliance of claim 1, wherein the ball socket is spring-loaded against a top wall of the detergent reservoir.

3. The washing machine appliance of claim 1, wherein the pretreatment assembly comprises two or more ball sockets, each of the ball sockets having a roller ball applicator rotatably mounted therein.

4. The washing machine appliance of claim 1, wherein a gap is defined between the ball socket and the roller ball applicator, a size of the gap being selected to generate some rolling resistance between the roller ball applicator and the ball socket.

5. The washing machine appliance of claim 1, wherein the roller ball applicator is a spherical ball defining a plurality of dimples.

6. The washing machine appliance of claim 1, wherein the ball socket comprises a spherical flange extending around a circumference of the roller ball applicator to retain the roller ball applicator.

7. The washing machine appliance of claim 1, wherein the ball socket is attached to a removable applicator, the removable applicator being inserted through the aperture in the detergent reservoir for inserting the ball socket into the detergent reservoir such that the roller ball applicator is positioned entirely within the detergent reservoir.

8. The washing machine appliance of claim 7, wherein the removable applicator defines a hand grip for facilitating application of the fluid additive from the detergent reservoir.

9. The washing machine appliance of claim 1, wherein the detergent reservoir is positioned below the top panel along the vertical direction, the top panel defining the aperture through which the roller ball applicator may extends partially above the top panel along the vertical direction.

10. The washing machine appliance of claim 1, wherein the detergent reservoir is defined at least in part by the top panel.

11. The washing machine appliance of claim 1, wherein the ball socket is defined by the detergent reservoir.

12. The washing machine appliance of claim 1, wherein the top panel and the detergent reservoir define a loading port adjacent the aperture in the detergent reservoir for receiving fluid additive into the detergent reservoir.

13. The washing machine appliance of claim 1, wherein the detergent reservoir defines a reservoir height and the roller ball applicator defines a ball diameter, the ball diameter being greater than the reservoir height.

14. A pretreatment assembly comprising:

a detergent reservoir defining an aperture and being configured for receiving a fluid additive;

a ball socket positioned at least partially within the aperture, the ball socket comprising one or more small resilient members positioned inside the ball socket; and a roller ball applicator rotatably mounted within the ball socket and being at least partially in contact with the fluid additive within the detergent reservoir, wherein the one or more small resilient members extend toward and contact the roller ball applicator.

15. The pretreatment assembly of claim 14, wherein the ball socket is spring-loaded against a top wall of the detergent reservoir.

16. The pretreatment assembly of claim 14, wherein the pretreatment assembly comprises two or more ball sockets, each of the ball sockets having a roller ball applicator rotatably mounted therein.

17. The pretreatment assembly of claim 14, wherein the ball socket comprises a spherical flange extending around a circumference of the roller ball applicator to retain the roller ball applicator.

18. The pretreatment assembly of claim 14, wherein the ball socket is attached to a removable applicator, the removable applicator being inserted through the aperture in the detergent reservoir for inserting the ball socket into the detergent reservoir such that the roller ball applicator is positioned entirely within the detergent reservoir.

19. The pretreatment assembly of claim 18, wherein the removable applicator defines a hand grip for facilitating application of the fluid additive from the detergent reservoir.

20. The pretreatment assembly of claim 14, wherein the detergent reservoir defines a reservoir height and the roller ball applicator defines a ball diameter, the ball diameter being greater than the reservoir height.

* * * * *